United States Patent [19]

Tracy

[11] 4,099,596

[45] Jul. 11, 1978

[54] ESCAPE DEVICE

[76] Inventor: Thomas Ray Tracy, 2175 Fairmeadow Dr., Boise, Id. 83702

[21] Appl. No.: 703,706

[22] Filed: Jul. 8, 1976

Related U.S. Application Data

[63] Continuation-in-part of Ser. No. 678,641, Apr. 20, 1976.

[51] Int. Cl.[2] ..... A62B 1/20

[52] U.S. Cl. ..... 182/48

[58] Field of Search ..... 182/48, 49; 193/25 R, 193/25 C

[56] References Cited

U.S. PATENT DOCUMENTS

| | | | |
|---|---|---|---|
| 913,117 | 2/1909 | Feyma | 182/49 |
| 1,825,271 | 9/1931 | Karberg | 2/237 |
| 3,977,495 | 8/1976 | Zephinie | 182/48 |
| 3,994,366 | 11/1976 | Okuma | 182/48 |

*Primary Examiner*—Reinaldo P. Machado

*Attorney, Agent, or Firm*—Strauch, Nolan, Neale, Nies & Kurz

[57] ABSTRACT

A safety device for enabling people to escape from burning buildings or the like comprises a normally folded flexible tube with a landing pad at its lower end that unfolds to vertical chute condition, the interior of the tube being slippery to provide against snagging and the like and the unfolded tube being formed with elastic restrictions at successive vertical levels that snub the descent to a safe speed.

3 Claims, 3 Drawing Figures

ESCAPE DEVICE

This is a continuation-in-part of Ser. No. 678,641 filed Apr. 20, 1976 for Escape Device.

The present invention relates to escape devices and particularly to detailed improvements in escape devices of the type disclosed in the above application, contributing to efficency and safety in operation.

PREFERRED EMBODIMENTS

Figure 1:
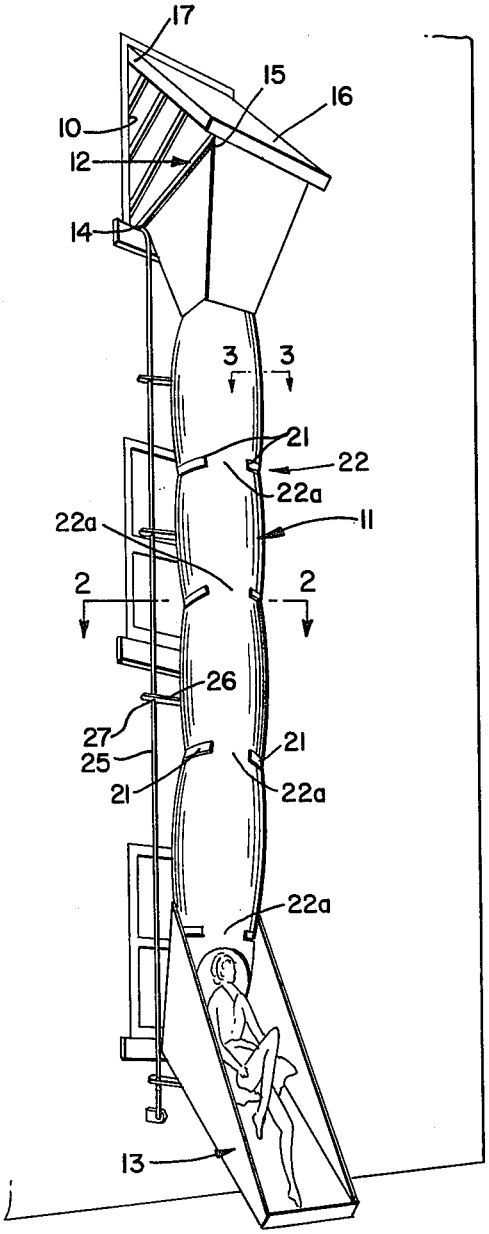
FIG. 1 is a diagrammatic view showing an escape device containing the invention in improved embodiment.
Figure 3:
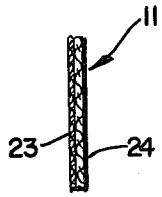
FIG. 3 is a fragmentary enlarged section showing the laminated nature of the escape chute wall.

FIG. 1 shows a form of the invention with the device in the expanded condition. The device comprises a flexible walled tube 11 extending from a rectangular frame 12 at a building opening 10 level to the ground where the open lower end of the tube is disposed above the upper end of an inclined landing pad 13.

In general the frame 12 may be about the same as disclosed in said application, except that the upper end of the tube 11 is secured to the rectangular sides. One side of the frame may be pivoted at 14 to the building at the bottom edge of the opening and the opposite side may have a slide pivot connection at 15 to a frame or shutter 16 which in turn is pivoted at 17 to the building at the upper edge of opening 10.

In practice the longitudinally collapsed tube and frame 12 are normally pivoted back into the opening 10 with shutter 16 closed. When the escape device is used, shutter 16 is pushed out to swing frame 12 to horizontal location allowing the flexible tube 11 to gradually unfold and drop toward the ground, as disclosed in said application.

The invention here embodies at least two major differences over the structure disclosed in said application. One of these is the nature and arrangement of the tube diameter restricting straps, and the other is concerned with the laminated form of the tube wall.

In this embodiment, instead of there being a single semicircular strap at each level, there is provided at each of various levels two circumferentially spaced straps or bands 21. The two straps at each level are elastic bands about two inches wide sewn exteriorly on tube 11 at opposite sides, with their opposite ends equally circumferentially spaced. The bands 21 are such that when sewn to the tube they materially constrict the effective diameter of the tube 11. For example where tube 11 is 60 inches in circumference it is constricted to about 26 inches in circumference at the constricted levels 22.

In practice the constricted levels 22 are advantageously about eithteen inches apart longitudinally of tube 11.

The flexible wall of tube 11 is laminated comprising an inner layer 23 of very fine mesh slippery nylon or like rip and snag proof fabric and an outer layer 24 of more sturdy fabric which is preferably a canvas woven from fireproof strands, or coated with a fireproofing material. These two layers are advantageously secured together at the levels where the bands 21 are sewn to the tube 11.

In operation, the smooth slippery inner layer offers little or no resistance to a body sliding down the tube layer 23 is virtually snag-proof so that heel, buckle and like projections do not catch during descent.

Figure 2:
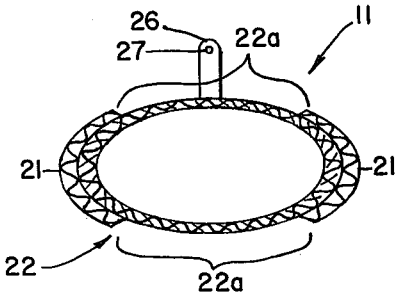
FIG. 2 is a section substantially on line 2—2 in FIG. 1.

In effect the speed of descent of the individual is almost wholly controlled by the elastic restrictive actions at the various levels 22, each level imparting an effective snubbing action to the descending body thereby reducing acceleration and maintaining safe control. Simultaneously, the smooth, uninterrupted areas *22a* in the front and rear of the chute in the vicinity of each restricted area 22, between the ends of bands 21 (FIG. 2), permit the user to slide by without snagging of the user's heels, elbows, etc. in the chute. In short, these areas *22a* define smooth, uninterrupted regions from top to bottom of the chute, front and rear, to permit the user to easily slide through the chute.

Where the building is over four floors in height, it may be advantageous to provide a fixed vertical guide wire or cable 25 along the outer side of the building and attach tubing thereto by a series of straps 26 having eyelets 27 through which the cable is threaded. This ensures direct steadied vertical descent of the unfolded tube 11, even though a violent wind may be blowing.

The landing pad 13 is attached to the lower open end of tube 11, preferably as disclosed in said application, so that a persn sliding down the tube will land on the pad at an angle which will cushion the fall and at the same time move away from the building.

The angle of the landing pad in the foregoing embodiment is preferably about 45° to the vertical.

In operation, the normally closed shutter 16 is pushed out from within the building and the folded tube with the landing pad on its lower end drops out of the opening and down to the ground. The length of the tube is such that the lower edge of the inclined landing pad is approximately at ground level.

The invention may be embodied in other specific forms without departing from the spirit or essential characteristics thereof. The present embodiments are therefore to be considered in all respects as illustrative and not restrictive, the scope of the invention being indicated by the appended claims rather than by the foregoing description, and all changes which come within the meaning and range of equivalency of the claims are therefore intended to be embraced therein. What is claimed and desired to be secured by Letters Patent is:

1. An escape device comprising a folded annular pack consisting of a longitudinally folded open ended flexible tubular chute and an attached cushion pad maintained in assembly therewith, a support frame for mounting the pack at a building opening or the like, means connecting the upper open end of the chute to said frame, said pad being connected to the lower end of said chute, means whereby the chute may be released to unfold downwardly so that the lower end of said chute may be lowered toward the ground, longitudinally spaced elastic restriction means spaced at diferent levels along the unfolded chute for periodically successively slowing the descent of a body entering the upper end of said chute, each of said restriction means comprising at least two circumferentially separate elastic bands secured externally on the chute with their opposite ends in spaced relation to thereby define between said opposite ends smooth, uninterrupted areas in said chute which effectively prevent catching or snagging of a user's extremities such as elbows and heels in the area of said restriction means as the user falls through said chute and means whereby said pad is disposed angularly relative to the chute axis across and extending away from the open lower end of said chute in the unfolded position of the pack.

2. An escape device as defined in claim 1, wherein the wall of said flexible chute is laminated, there being an inner layer of relatively smooth and slippery material and an outer layer of sturdy fireproof material.

3. The escape device defined in claim 2, wherein the inner layer is a fine weave synthetic plastic cloth.

* * * * *